US006872028B2

(12) United States Patent
Aeschlimann et al.

(10) Patent No.: US 6,872,028 B2
(45) Date of Patent: Mar. 29, 2005

(54) SLIP FORM PAVER

(75) Inventors: Werner Aeschlimann, Grobbendonk (BE); Raymond Smolders, Herentals (BE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 10/221,478

(22) PCT Filed: Jun. 13, 2002

(86) PCT No.: PCT/EP02/06490

§ 371 (c)(1),
(2), (4) Date: Jun. 5, 2003

(87) PCT Pub. No.: WO02/101150

PCT Pub. Date: Dec. 19, 2002

(65) Prior Publication Data

US 2003/0185626 A1 Oct. 2, 2003

(51) Int. Cl.[7] ..... E01C 19/12
(52) U.S. Cl. ..... 404/105; 404/101
(58) Field of Search ..... 404/101, 105, 404/106

(56) References Cited

U.S. PATENT DOCUMENTS 3,970,405 A * 7/1976 Swisher et al. ..... 404/105
6,471,442 B1 * 10/2002 Deeb et al. ..... 404/96
6,497,531 B2 * 12/2002 Sipherd et al. ..... 404/111

FOREIGN PATENT DOCUMENTS

| | | | |
|---|---|---|---|
| DE | 198 14 052 A1 | | 3/1998 |
| EP | 1 213 389 | * | 6/2002 |
| WO | WO 95/28528 | | 4/1995 |
| WO | WO 97/04176 | | 6/1996 |
| WO | 99/50503 | * | 10/1999 |

* cited by examiner

*Primary Examiner*—Gary S. Hartmann
(74) *Attorney, Agent, or Firm*—Diller, Ramik & Wight

(57) ABSTRACT

In a slip-form paver comprising a tractor (2) consisting of a machine frame (4) telescopable at least transversely to the traveling direction, with working means being mounted thereto, where at least one of the working means is displaceable along a longitudinal guide (56) across the entire working width transversely to the traveling direction, characterized in that the longitudinal guide (56) for the working means as a predetermined length and is supported at the machine frame (4) for free displacement transversely to the working direction without adjustment to a certain working width.

44 Claims, 11 Drawing Sheets

8
118
112
102
116
20
104
108
XIII
XIII
116
104
112
108
118
8
118
112
104
108
118

SLIP FORM PAVER

BACKGROUND OF THE INVENTION

Such slip-form pavers are required for making concrete road surfaces. Known slip-form pavers comprise a tractor consisting of a machine frame and four track assemblies carrying different working means for spreading and smoothing the concrete.

Since the desired width of the concrete lanes can vary, for example at merging lanes, a rearrangement of the slip-form paver is often required which can take a restructuring time of two to three days depending on the necessary extent of the restructuring work.

Such interruption of the work is undesirable so that slip-form pavers have been developed which have machine frames that can the widened telescopically (WO95/28525, WO97/04176).

While it is relatively simple to change the frame width of the machine frame telescopically, severe problems may arise if at the same time also the working means have to be telescopically changed in the working width.

From DE-A-198 14 052, it is known to mount the machine frame with a transverse rail guide having at least two telescopically movable rails, and that a carriage for a working means is movable in the transverse direction on the rail guide. Such a device allows for the displacement of a working means over the entire working width, with no restructuring work required even when the working width is altered.

The carriage has a plurality of rollers with parallel adjacent running grooves corresponding in number to the number of rails so that at least one of the running grooves engages one of the rails. In this manner, the track assembly may be displaced over the entire working width regardless of the working width set.

It is a disadvantage of the known solution that, due to the subdivision of the rail guides in the transverse direction, the rigidity for the track assembly is not sufficient, when great forces are exerted through the working device mounted to the track assembly. Moreover, the transition from one rail element to the next rail element prevents the guiding of the carriage from being continuously stepless.

Therefore, it is an object of the present invention to improve a slip-form paver of the type mentioned above such that a working means is displaceable in a stepless manner over the entire working width in a direction transverse to the traveling direction with a great rigidity of the longitudinal guide.

SUMMARY OF THE INVENTION

The invention advantageously provides that the longitudinal guide for the working means has a predetermined length and is supported at the machine frame for free displacement transverse to the working direction without adaptation to a certain working height. The longitudinal guide is unitary so that the working means may be reciprocated as desired on the longitudinal guide without any transition. Moreover, the longitudinal guide itself is displaceable on the machine frame in a direction transverse to the working direction. Since the longitudinal guide is freely displaceable, it will only be moved when necessary because of the traveling path of the working means. The support of the longitudinal guide at the machine frame allows for a higher rigidity of the structure so that the working means may also be loaded with great forces without deformations occurring.

Preferably, the longitudinal guide has a length corresponding at least to the minimum working width of the telescopable machine frame. When the slip-form paver is operated with its minimum working width, the longitudinal guide does not have to be moved when the working means is reciprocated over the working width.

Further, the longitudinal guide may have a length that is less than the maximum working width of the telescopable machine frame. Here, it is possible that the longitudinal guide projects laterally beyond the working width when the minimum working width is set.

Preferably, it is provided that the machine frame comprises a supporting beam extending transversely to the working direction and accommodates the support for the longitudinal guide. Here, the supporting beam may be designed such that the support for the longitudinal guide has a great rigidity and therefor counteracts deformations of the guide means for the working means.

The supporting beam may be extended using lengthening pieces. Thus, the traveling path of the longitudinal guide can readily be lengthened if need be.

The longitudinal guide comprises two parallel beams vertically spaced apart. On this longitudinal guide, either a working means may be directly supported for displacement or a track assembly with a working means mounted thereto may be supported thereon.

The support for the longitudinal support comprises a plurality of rollers supported in the machine frame or the supporting beam, which are in engagement with the upper and the lower beam of the longitudinal guide.

Here, it may be provided that the upper and lower beams of the longitudinal guide are rectangular in cross section. The guide surfaces of the upper and the lower beams that engage the rollers are inclined under an angle of 30° to 60°, preferably 45°, with respect to a horizontal plane. On these guide surfaces, the rollers supported at the machine frame or the supporting beam corresponding to the inclination may roll.

The working means or a track assembly for a working means is supported on the inner side between the upper and the lower beam of the longitudinal guide, while the longitudinal guide is supported on the outside of the machine frame. In this manner, the working means or the carriage can reciprocate within the length of the longitudinal guide, while the longitudinal guide is simultaneously displaceable transverse to the traveling direction, if need be.

The working means or the carrige may be displaced on the longitudinal guide using a traction rope.

Preferably, a rope roll with a rope roll drive is arranged on each longitudinal beam of the machine frame or on the carriage, respectively, with which the respective free end of the traction rope may be wound up, wherein, as an alternative, only one of the rope roll drives may be controllable. The preferably hydraulic rope roll drives are controlled, for example, by a 4/3 directional control valve.

In an advantageous embodiment, the track assembly is connected to flexible hydraulic lines supplied via a hose reel. The hydraulic connection on the track assembly makes it possible to supply hydraulic oil to hydraulic drives of the working means mounted on the carriage.

The working means may be, for example, a vertically adjustable distributing knife.

At the front of the base frame, a vertically adjustable front wall may be mounted having a telescopically movable wall element on both sides thereof. With the telescopically movable wall elements, the front wall can be adapted to a changed working width of the slip-form paver without any restructuring and, when the machine frame is telescopically widened, it may be automatically extended to the required working width.

The front wall elements are articulately connected to the front wall, on the one hand, and to the longitudinal beam, on the other hand, to which they are connected articulately and vertically adjustably. Thereby, the angle of inclination of the front wall elements can be adjusted.

The working means mounted on the carriage may also be a longitudinal smoothing board.

Further, the base frame may be mounted with a transverse smoothing board consisting of two board segments hingedly connected in the middle of the working width to form a roof-shaped profile.

The angle of inclination of the board segments may be adjustable via a piston-cylinder unit acting between the board segments. A stop limits the inclination angle downward so that negative inclination angles cannot be set.

The board segments or extension boards fastened thereto may have transversely extending slide rails on which the longitudinal beams can slide in the transverse direction so that the board segments or their extensions can laterally project beyond the longitudinal beams. In this way, it is ensured also for a transverse smoothing board that an adaptation to different working width is possible in a wide range and that with a larger adjustment of the working width, only extension members must be mounted or disassembled.

It is provided that the board segments are fastened to the longitudinal beams so as to be vertically adjustable.

The following is a detailed description of an embodiment of the invention:

DESCRIPTION OF THE PREFERRED EMBODIMENTS

Figure 1:
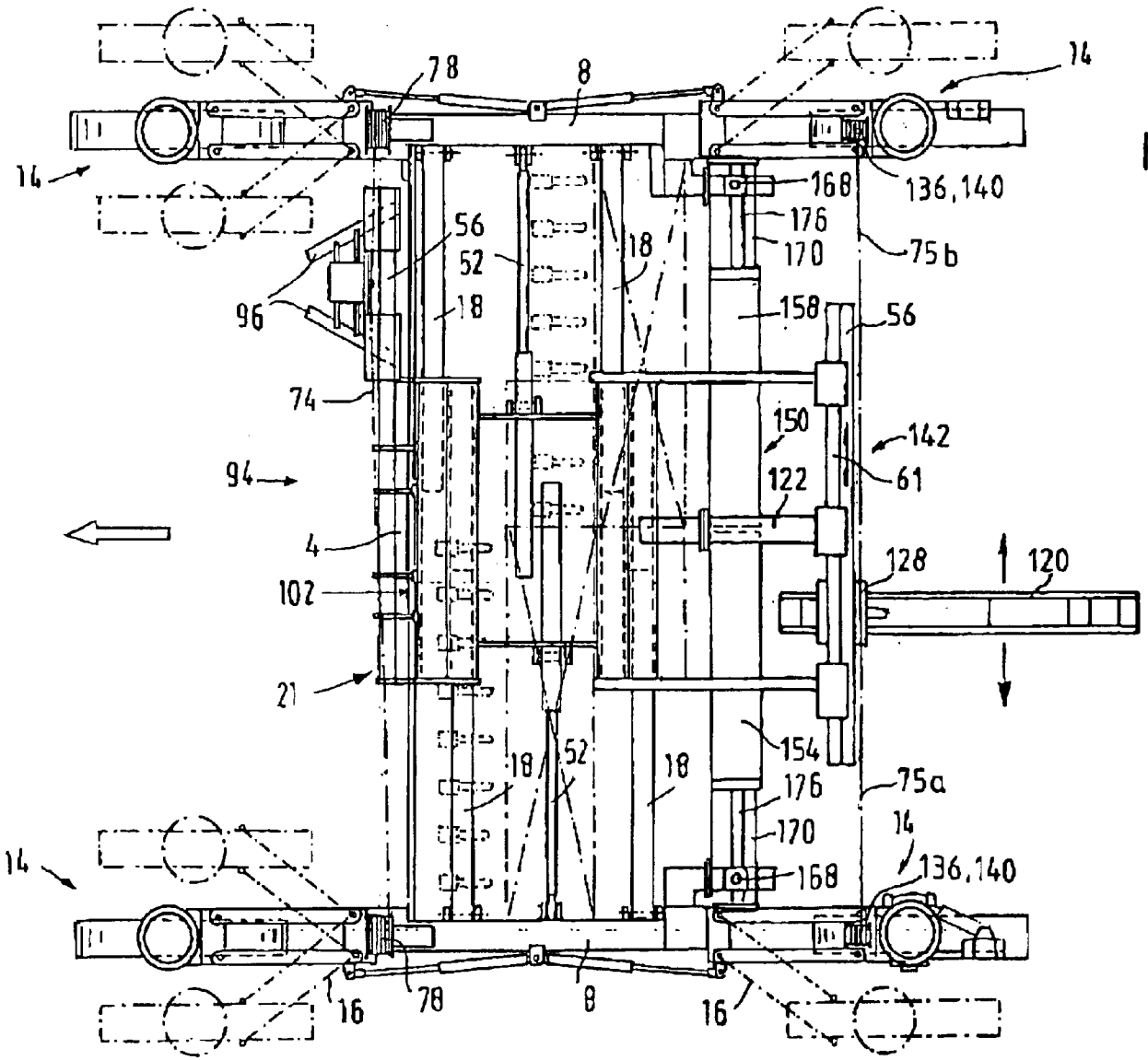
FIG. 1 is a top plan view on the slip-form paver.

The slip-form paver has a tractor 2 consisting of a machine frame 4 with longitudinal beams 8 extending in parallel to the working direction and telescopically movable cross beams 18 extending transverse to the working direction for variably adjusting the working width. The cross beams are supported in a base frame 20, a total of four cross beams 18 projecting from a base frame arranged in the middle of the working width and being connected with the longitudinal beams 8.

The cross beams 18 are mutually offset in the base frame 20 so that, for example, the working width may be varied between 3 m and 6 m. The cross beams 18 may also be adapted for double telescopic extension should substantially larger working widths be desired to be set.

At the front and the rear end of the longitudinal beams 8, a respective track assembly 14 is articulately fastened guided in a parallelogram-like manner. The parallelogram guide that allows for a track width adjustment without changing the working width, two parallelogram connecting rods 16 are provided, respectively, for articulately connecting the track assemblies 14 with the longitudinal beam.

Figure 16:
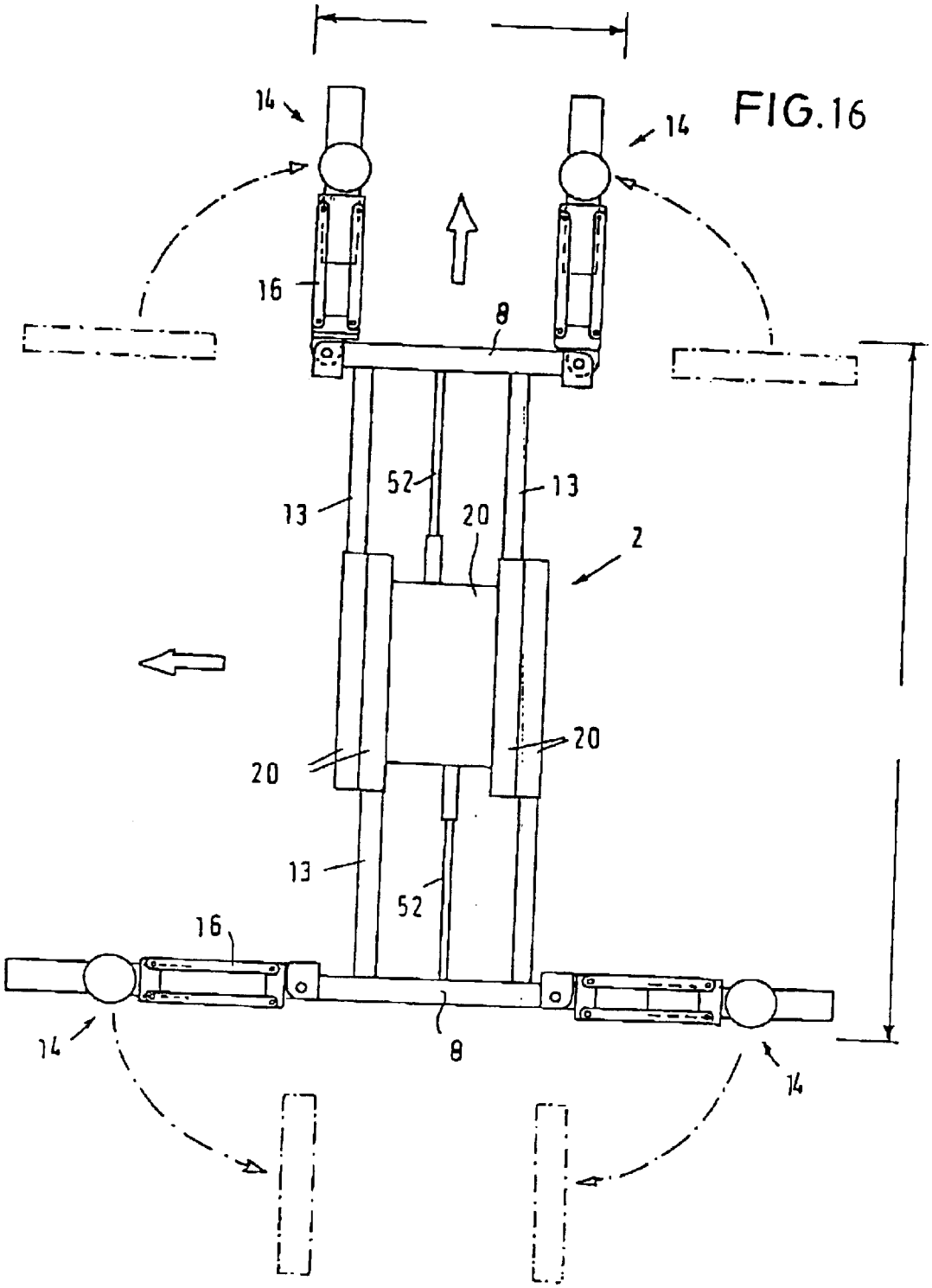
FIG. 16 is a schematic representation of the pivotability of the track assemblies.

Moreover, the track assemblies at the ends of the longitudinal beams 8 can be pivoted through an angle of 90° so that the slip-form paver can be loaded onto a flatbed trailer transversely to its working direction without exceeding the maximum allowed transport width (FIG. 16).

Further, the track assemblies 14 allow for a vertical adjustment of the machine frame in a manner known per se.

Figure 2:
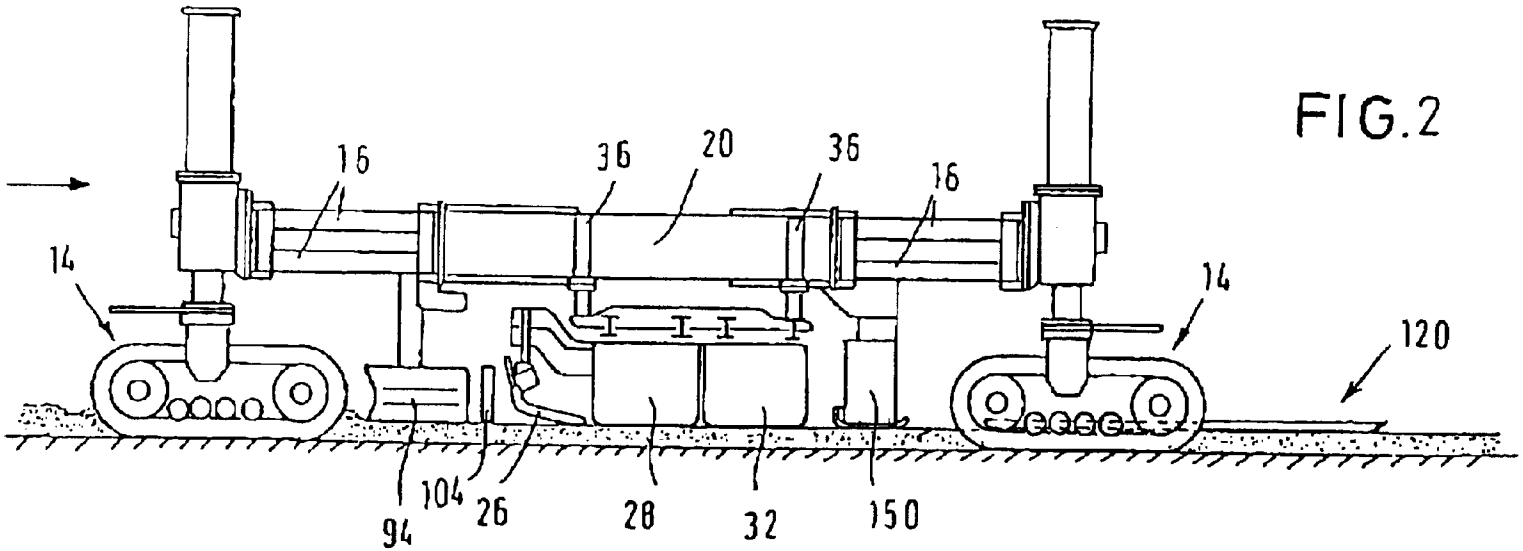
FIG. 2 is a side elevational view of FIG. 1.
Figure 3:
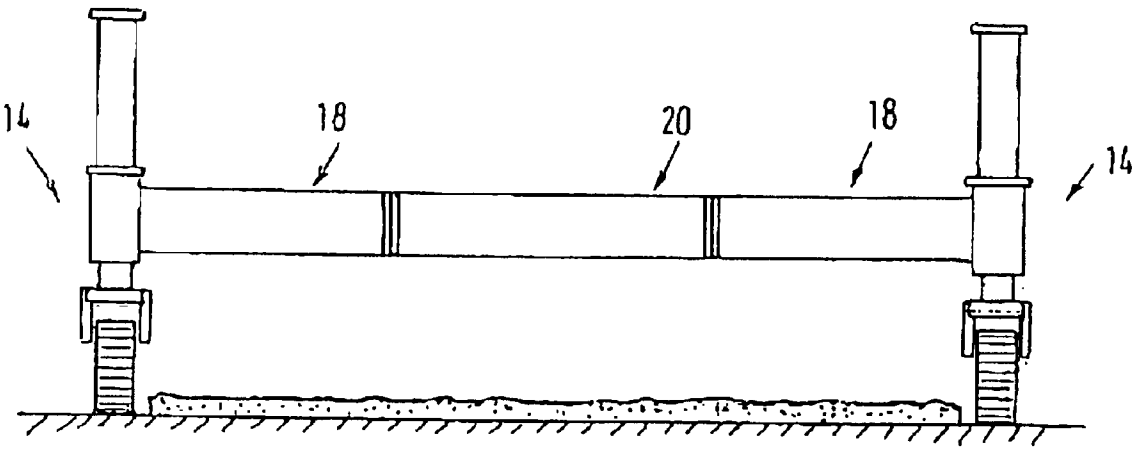
FIG. 3 is a front view of the machine frame.
Figure 4:
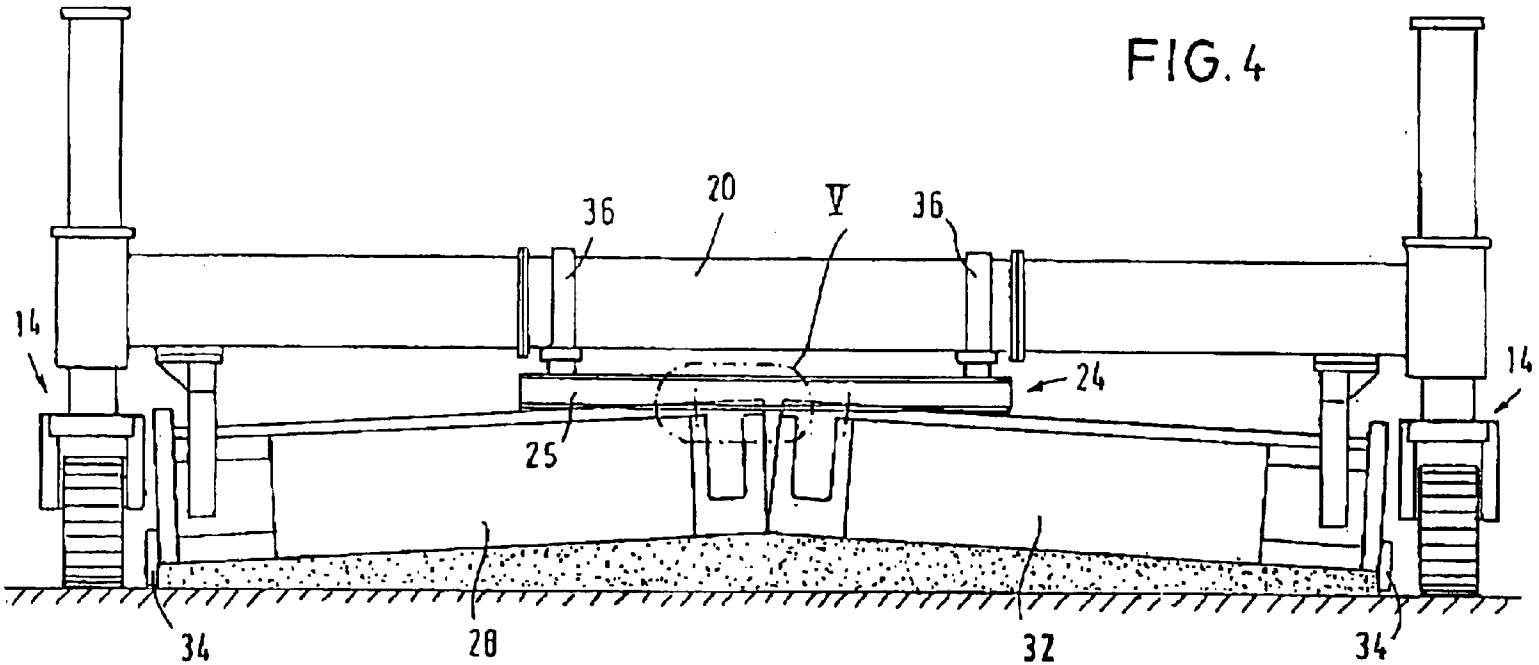
FIG. 4 is a front view of the concrete troughs.
Figure 5:
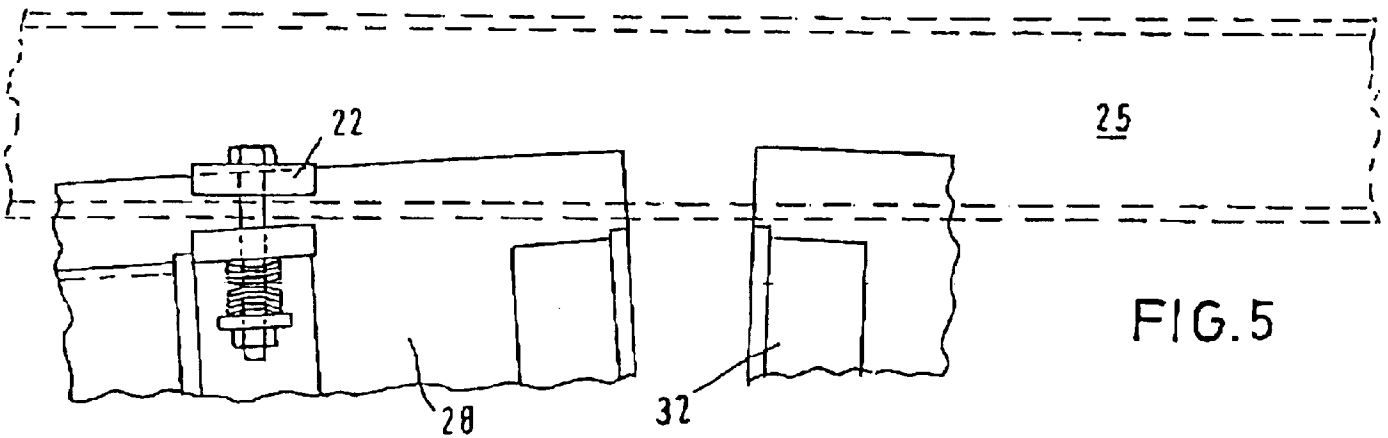
FIG. 5 illustrates the detail V in FIG. 4.
Figure 6:
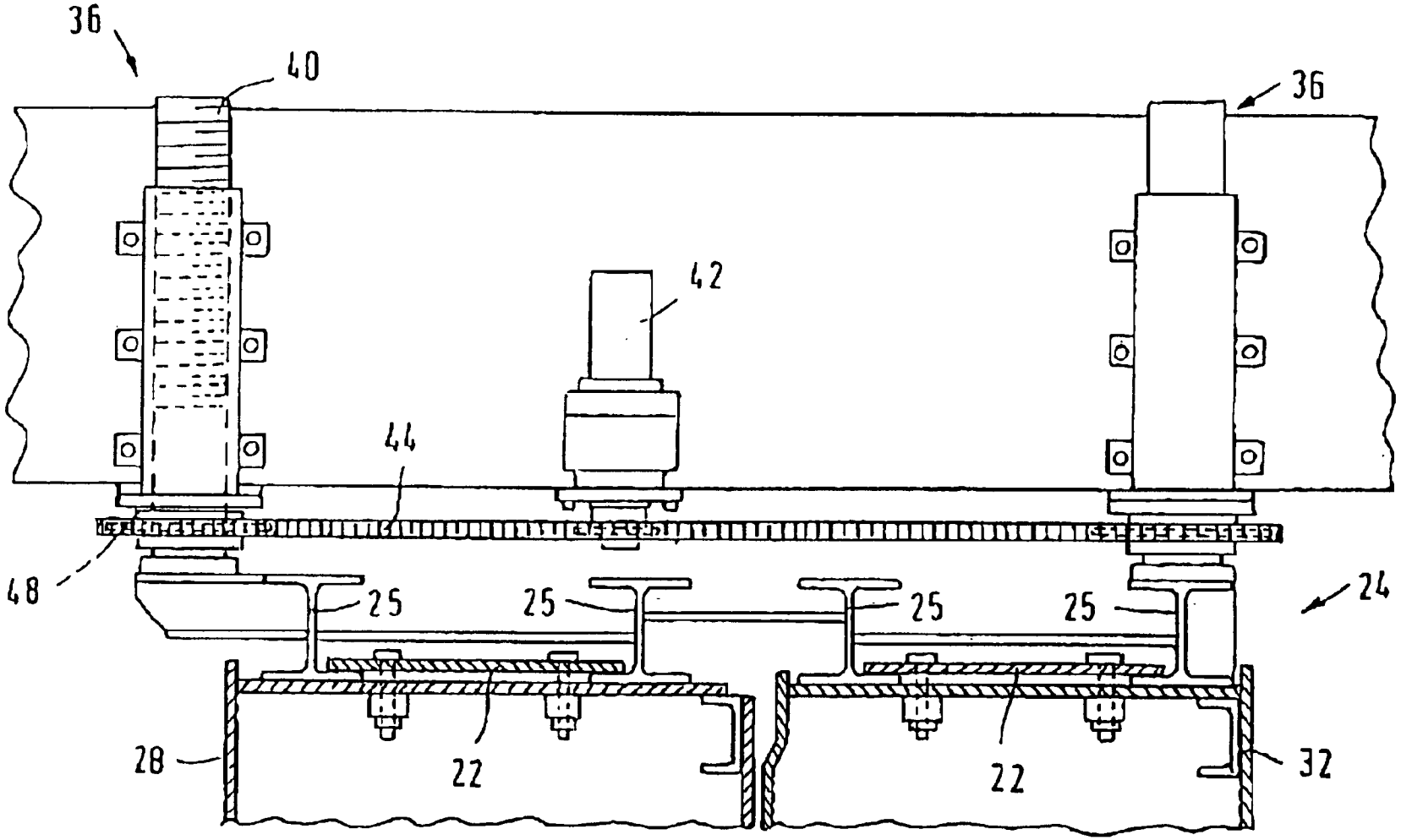
FIG. 6 illustrates the intermediate frame with the concrete troughs fastened therein.
Figure 7:
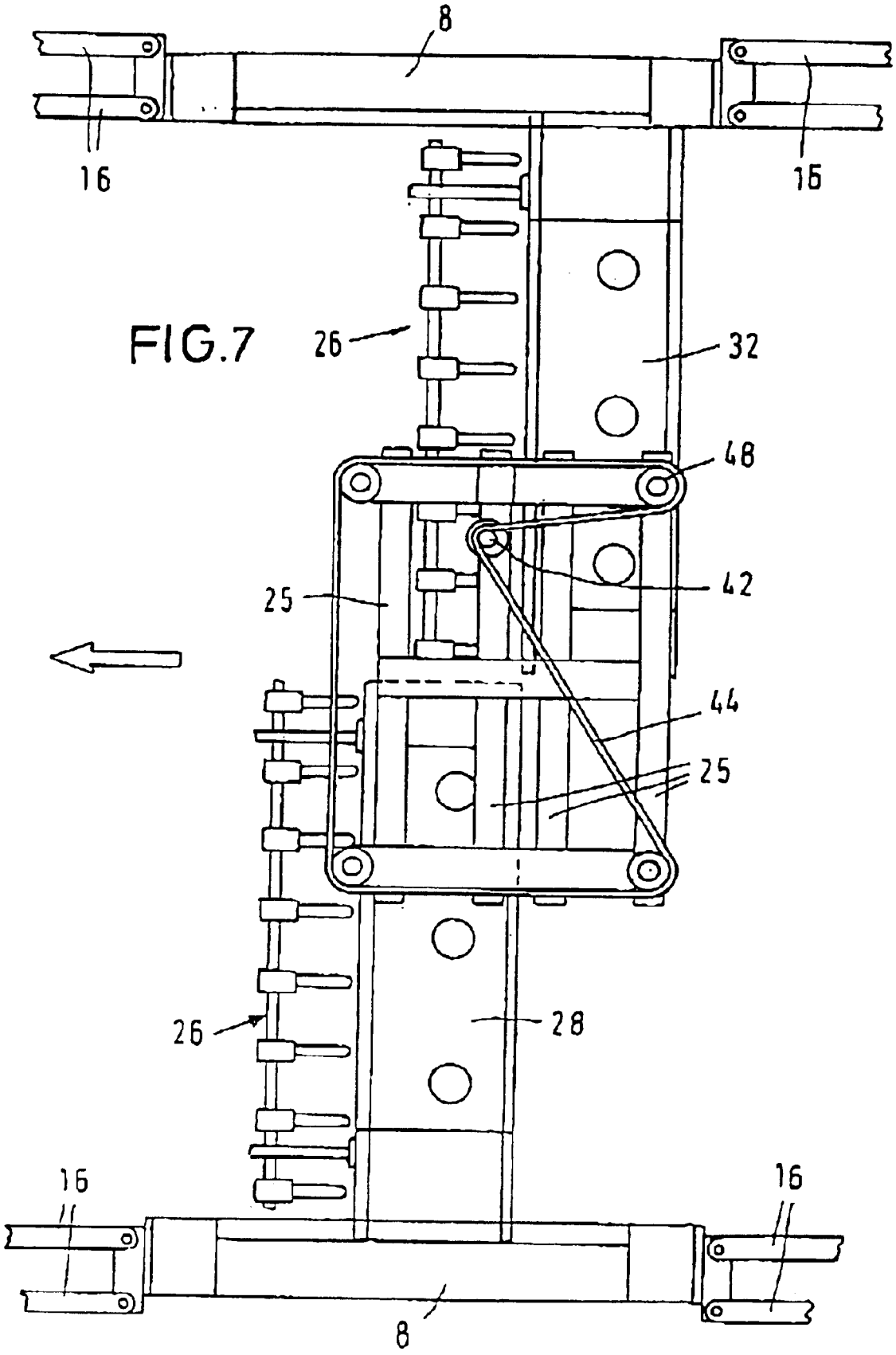
FIG. 7 is a top plan view on the concrete troughs with vibratory liquefying means.

As evident from FIGS. 1 and 2, the concrete troughs 28, 32 are arranged successively in the working direction, together covering the working width set. The concrete troughs 28, 32 are fixedly mounted in an articulated manner on the outside of the longitudinal beams 8. When the working width is telescopically changed through the cross beams 18, the concrete troughs 28, 32 are automatically extended or narrowed as well. In doing so, the upper edges of the concrete troughs 28, 32 slide in the intermediate frame 24 that may be provided with four double T profiles, for example, for guiding the concrete troughs 28, 32 (FIG. 6). The concrete troughs 28, 32 are articulately supported at the intermediate frame 24 for transverse displacement. The hinge is formed by a clamping strip 22 clamping one leg of the double T profile 25 with spring bias (FIG. 5 and FIG. 6).

When changing the working width, the inclination angle of the concrete troughs 28, 32 also changes.

Using the vertical adjustment of the intermediate frame 24, the desired inclination angle of the concrete troughs 28, 32 can very quickly be set without a new leveling of the slip-form paver being necessary. By means of the vertical adjustment means 38 a roof angle between 0 and 3°, for example, may be set quickly. The vertical adjustment means 36 may be a spindle and nut drive. The nut has a pinion 48 on its exterior and is held fixed in the axial direction relative to the base frame 20. A continuously running chain 44 driven by a drive motor 42 with a pinion, is coupled with all four spindle nuts so that all vertical adjustment means 36 are driven simultaneously and uniformly. In the embodiment illustrated in the Figs., four vertical adjustment means 36 are provided between the base frame 20 and the intermediate frame 24. As an alternative, a combination of piston cylinder units and a path measuring system may be used as the vertical adjustment means 36.

In front of the concrete troughs 28, 32, seen in the traveling direction, liquefying means 26 consisting of several vibratory bottles are provided in a conventional manner.

The outer ends of the concrete troughs 28, 32 are hinged to a supporting arm connected to the longitudinal beams 8 and have a lateral form 34 at their free ends.

Figure 8:
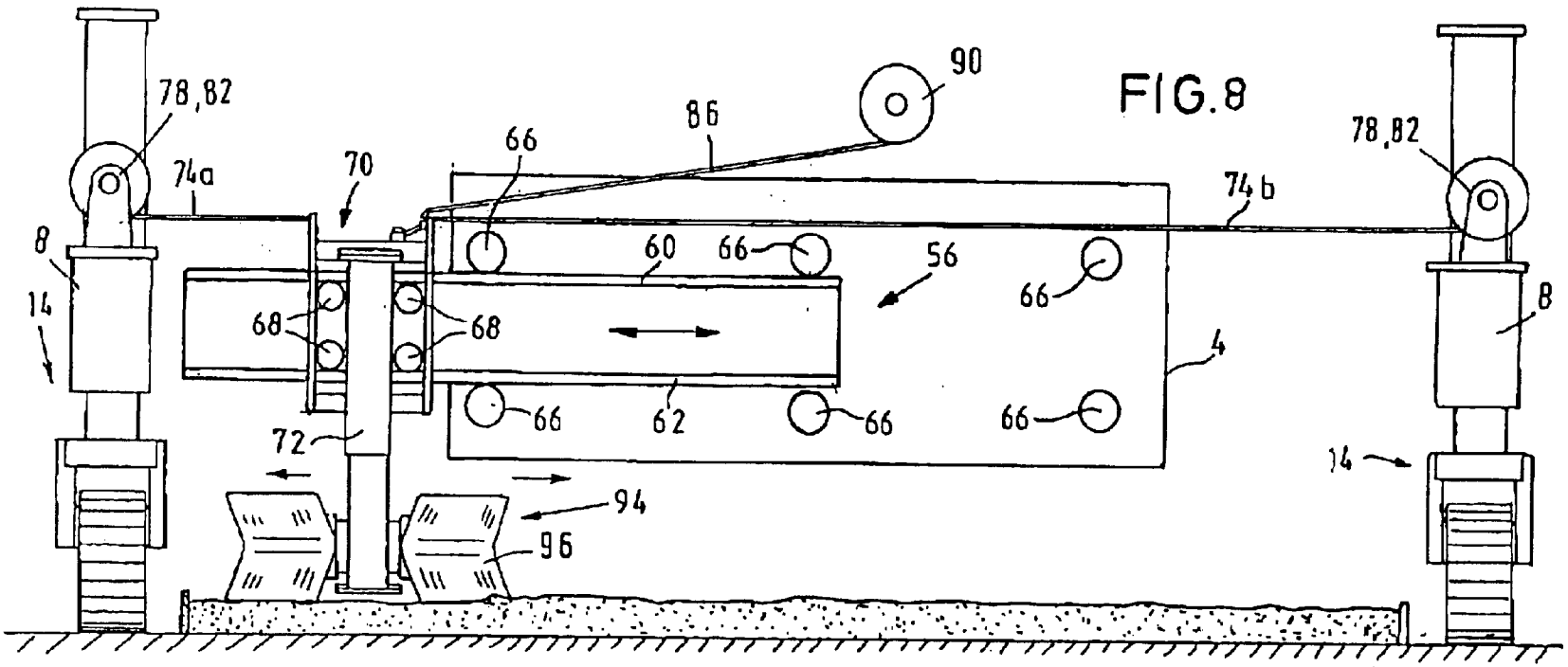
FIG. 8 illustrates a distributing knife.

FIG. 8 illustrates a distributing knife 94 with a vertically adjustable plough-like knife 96 adapted to be displaced over the entire working width by means of a carriage 70 and a longitudinal guide 56.

The carriage 70 is moved using a traction rope 74*a*, 74*b*, a rope winch 78 with a drive 82 being provided on the longitudinal beam 8. The rope winch drives 82 are hydraulic motors. Only one motor is driven at a time, the carriage 70 moving to the left or the right in the drawing, depending on which motor is driven.

The lifting cylinder 72 is supplied through wound flexible hydraulic conduits 86 which may be wound from a hose reel 90 fastened on the machine frame 4, for example, and which are kept under tension.

The longitudinal guide 56 has a predetermined length that can correspond to at least the minimum working width of the telescopable machine frame and which should be less than the maximum working width of the telescopable machine frame.

Figure 9:
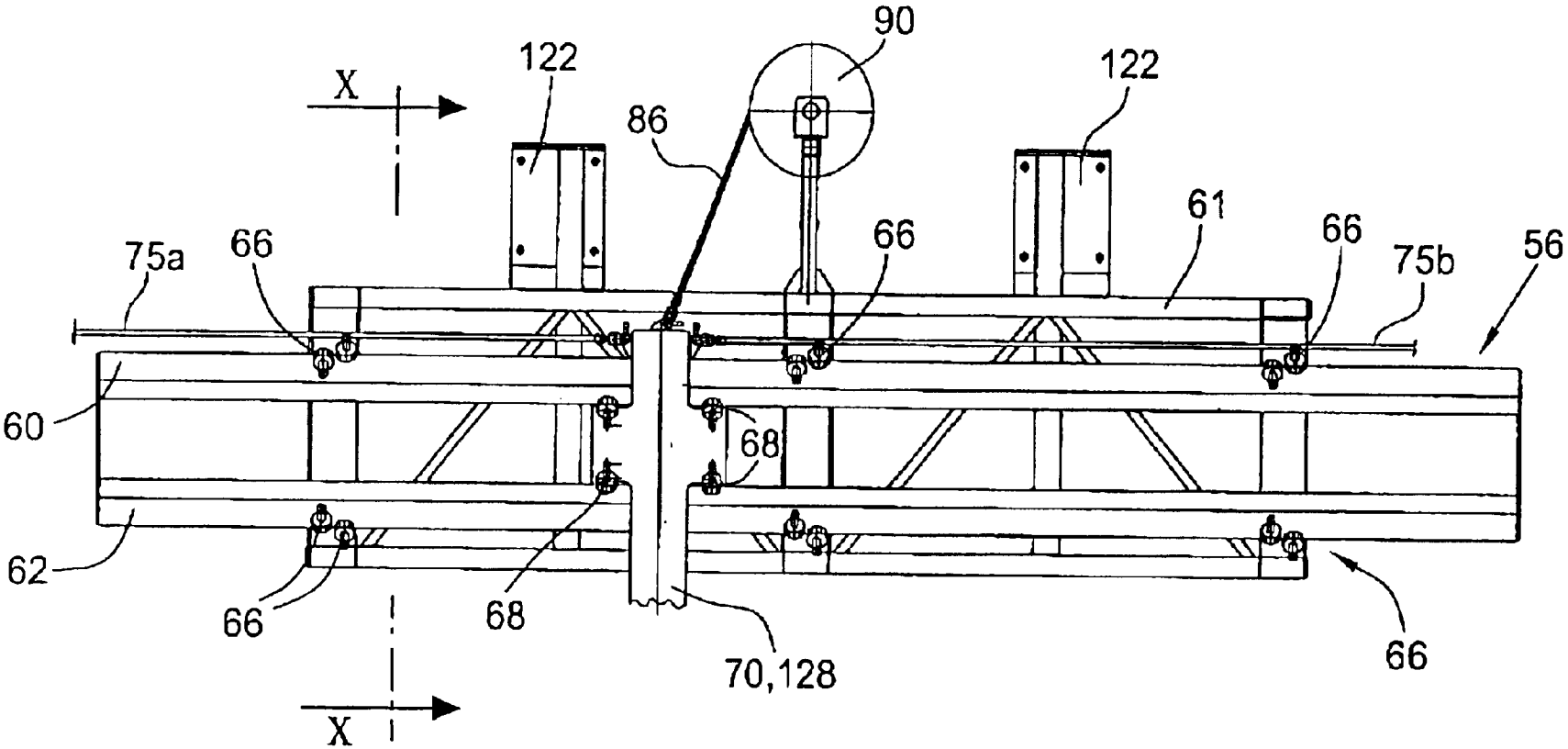
FIG. 9 is a front view of the longitudinal guide.

The longitudinal guide 56 illustrated in FIGS. 8 and 9 may comprise two vertically spaced parallel beams 60, 62 that form guide surfaces for a plurality of rolls 66 supported in the machine frame 4 or in a support beam 61. The rolls are arranged in the support beams 61 or at the machine frame 4 in opposite pairs with a vertical distance and a lateral horizontal distance therebetween, the rolls 66 being in engagement with the upper and lower beams 60, 62 on their respective outer sides. In FIGS. 8 and 9, respective roller pairs for the upper and the lower beams 60, 62 are provided in the transverse direction of the slip-form paver; it is understood that more than three pair of rollers could be arranged side by side. The running or guide surfaces of the upper and the lower beams 60, 62 that are in engagement with the rollers 66, extend under an angle between 30° and 60°, preferably 45°, relative to a horizontal plane.

Figure 10:
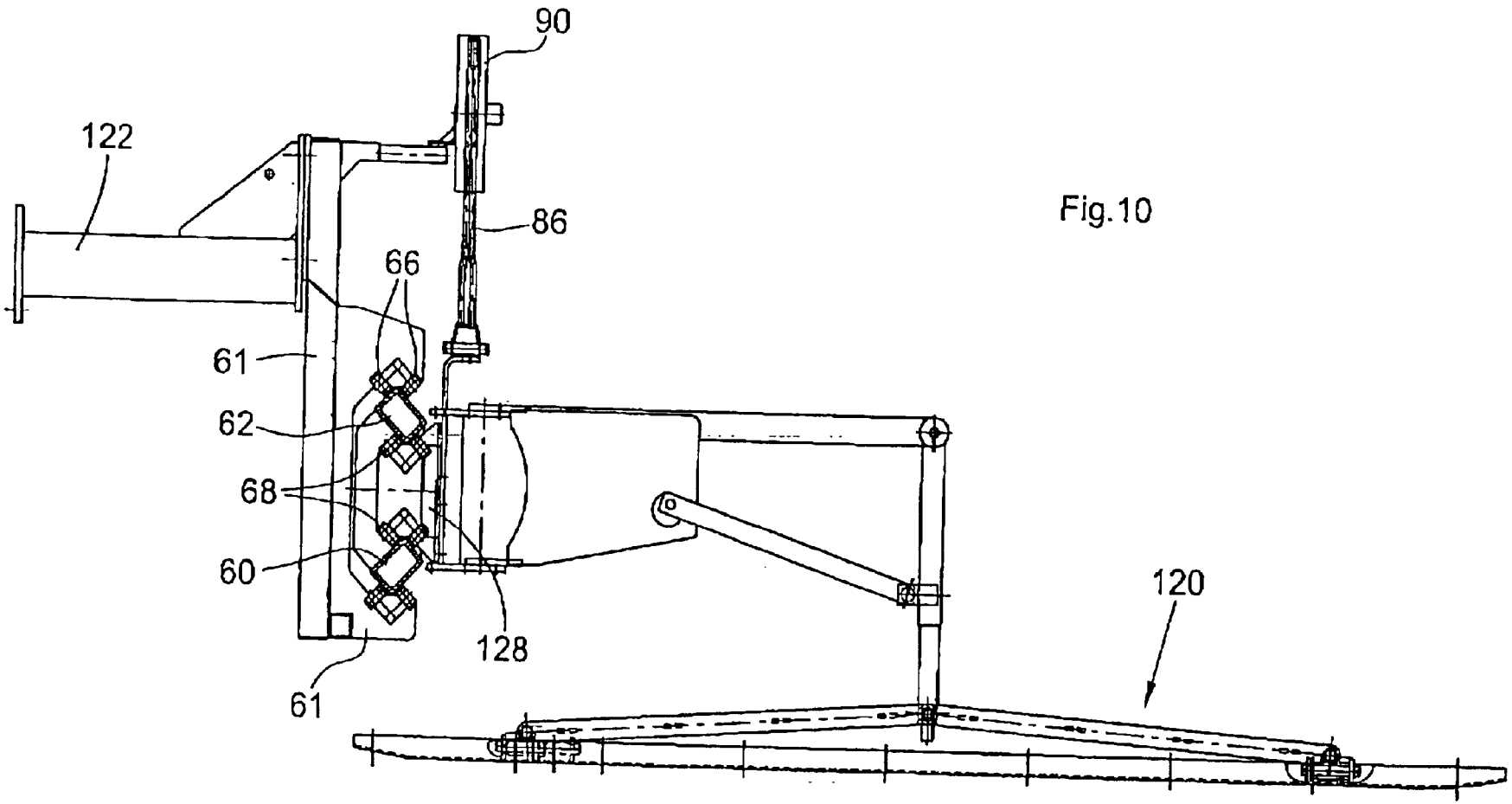
FIG. 10 is a side elevational view in partial section of the longitudinal guide of a longitudinal smoothing board.

FIG. 10 illustrates the arrangement of the rollers 66 in the support beam 61, where the axes of the rollers 66 of one pair of rollers intersect under an angle of 90°. The beams 60, 62 are, as is best seen in FIG. 10, rectangular in cross section, the guide surfaces for the rollers 66 extending under an angle of 45° to the horizontal plane. As an alternative, the beams 60, 62 may also be circular in cross section, the running surfaces of the rollers then being adapted to the radius of curvature of the beams 60, 62.

The longitudinal guide 56 in FIG. 8 is only schematically illustrated, but may be designed as in the detailed illustration in FIG. 9.

The longitudinal guide 56 accommodates a carriage 70 (FIG. 8) ora carriage 128 (FIG. 10) on its inside, to which a working means may be fastened that is intended to be moved across the entire working width of the slip-form paver.

The carriage 70, 128 also comprises horizontally and vertically spaced rollers 68 whose axes of rotation extend under an angle of 90° with respect to each other in a vertical plane parallel to the traveling direction and which roll on the inner side between the beams 60, 62 on the inner guide surfaces of the beams 60, 62. Of course, the inner guide surfaces of the beams 60, 62 may also extend not rectangular to each other, when the beams 60, 62 have another sectional shape.

The carriage 70, 128 or the working means provided with the rollers 68 corresponding to FIG. 10 may be reciprocated across the entire length of the longitudinal guide 56. If a larger working width is required, the longitudinal guide 56 may also freely move transversely to the traveling direction grace to its being supported in the support beam 61 or at the machine frame 4 so that the carriage 70, 128 or the respective working means is displaceable across the entire working width of the telescopable machine frame, without the working width having to be adjusted or a restructuring being required.

The longitudinal guide 56 has no drive of its own so that the movement of the longitudinal guide 56 depends only on the forces of the working means acting thereon. It is neither necessary to adjust a certain working width since different working widths are always available to the full extent so that the effective working width depends on the reversal of the carriage 70, 128.

The carriage 128 is driven via a traction rope 132 that can be wound up on both sides of the rail guide 142 using a rope winch 136 and the associated drive 140. Different from the embodiment in FIGS. 8 to 10, the rope winches 136 are not located on the longitudinal beam 8 but on the track assemblies 14, as is best seen in FIG. 1.

FIG. 10 illustrates a longitudinal smoothing board 120 mounted to the base frame 20 of the machine frame 4, as best seen in FIG. 1, using at least one beam 122 extending parallel to the working direction. The longitudinal smoothing board 120 may also be mounted directly to the machine frame 4 without using a beam 122. Similar to the distributing knife 94, the longitudinal smoothing board 120 may be moved across the entire working width using a carriage 128.

The carriage 128 is driven by a traction rope 75*a*, 75*b* that may be wound up on both sides of the longitudinal guide 56 using a respective rope winch 136 and an associated drive 140. In contrast with the embodiment of FIG. 8, the rope winches 136 are not located on the longitudinal beam 8 but on the track assemblies 14, as evident from FIG. 1.

As in the embodiment of FIG. 8, the longitudinal smoothing board 120 may also be connected via a hose reel 90 to flexible hydraulic hoses for the oscillating operation of the smoothing board.

Figures 11, 12, 13:
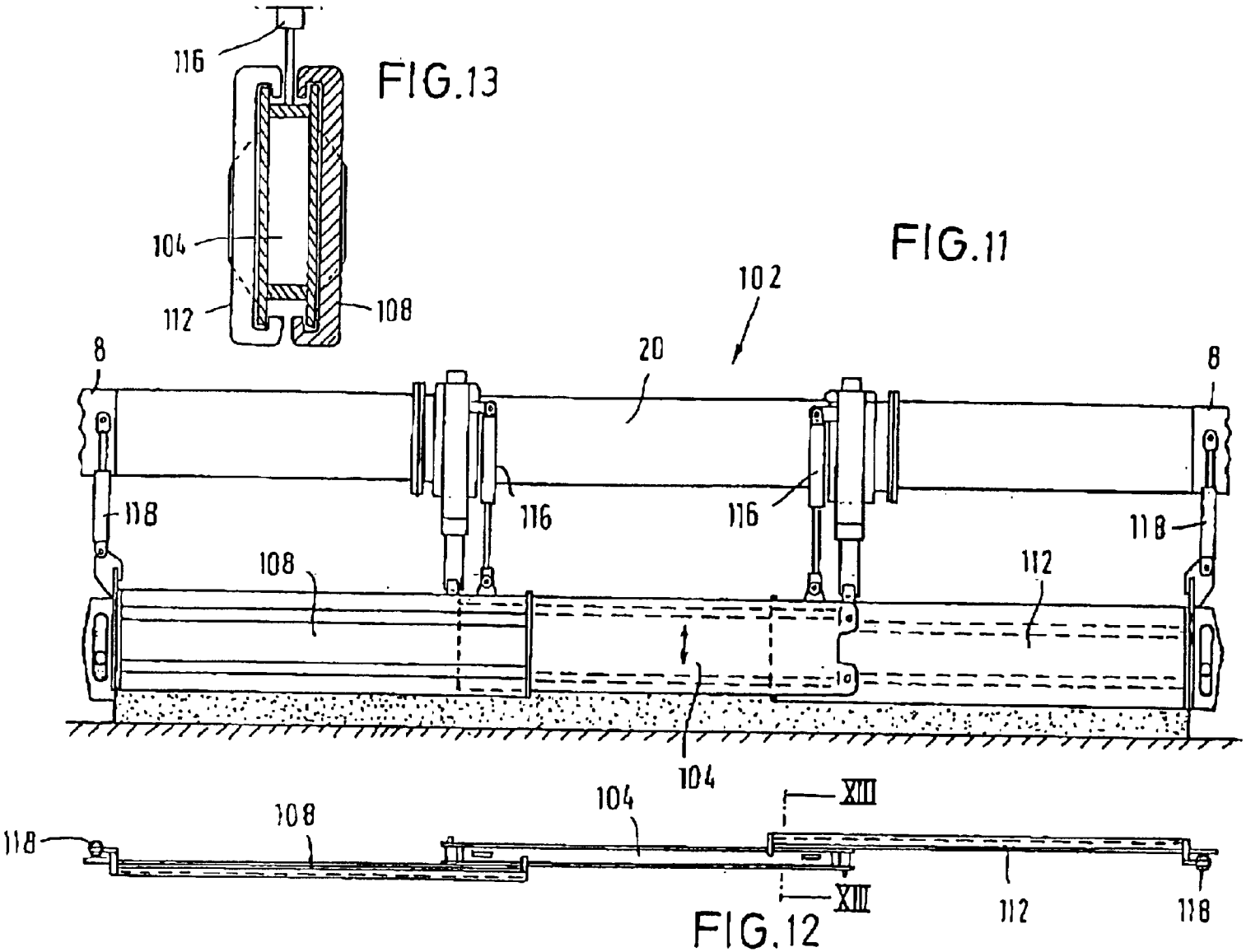
FIG. 11 illustrates a telescopically movable front wall.
FIG. 12 is a top plan view on the front wall.
FIG. 13 is a cross sectional view along line XIII—XIII in FIG. 12.

FIGS. 11, 12 and 13 illustrate a variable front wall 102 comprising a fixed central member 104 and two telescopically movable front wall elements 108, 112 arranged successively in the working direction, as best seen in FIG. 12.

The outer front wall elements 104, 108 are connected to the longitudinal beams 8 through a dog and are telescopically displaced when the machine frame is extended during a change of the working width. The central member 104 is vertically adjustable in parallel using two lifting cylinders 116 fastened at the base frame 20.

The telescopically movable front wall elements 108, 112 are hingedly supported in elongated holes 110 in the longitudinal beams 8 and can also be lifted or lowered at their outer ends by means of a lifting cylinder 118.

The telescopically movable front wall elements 104, 108 embrace, as is best seen in FIG. 13, the central front wall member 104 in form fit, but with sufficient play so that the front wall elements 108, 112 are also telescopically movable when a roof profile is set.

Figure 14:
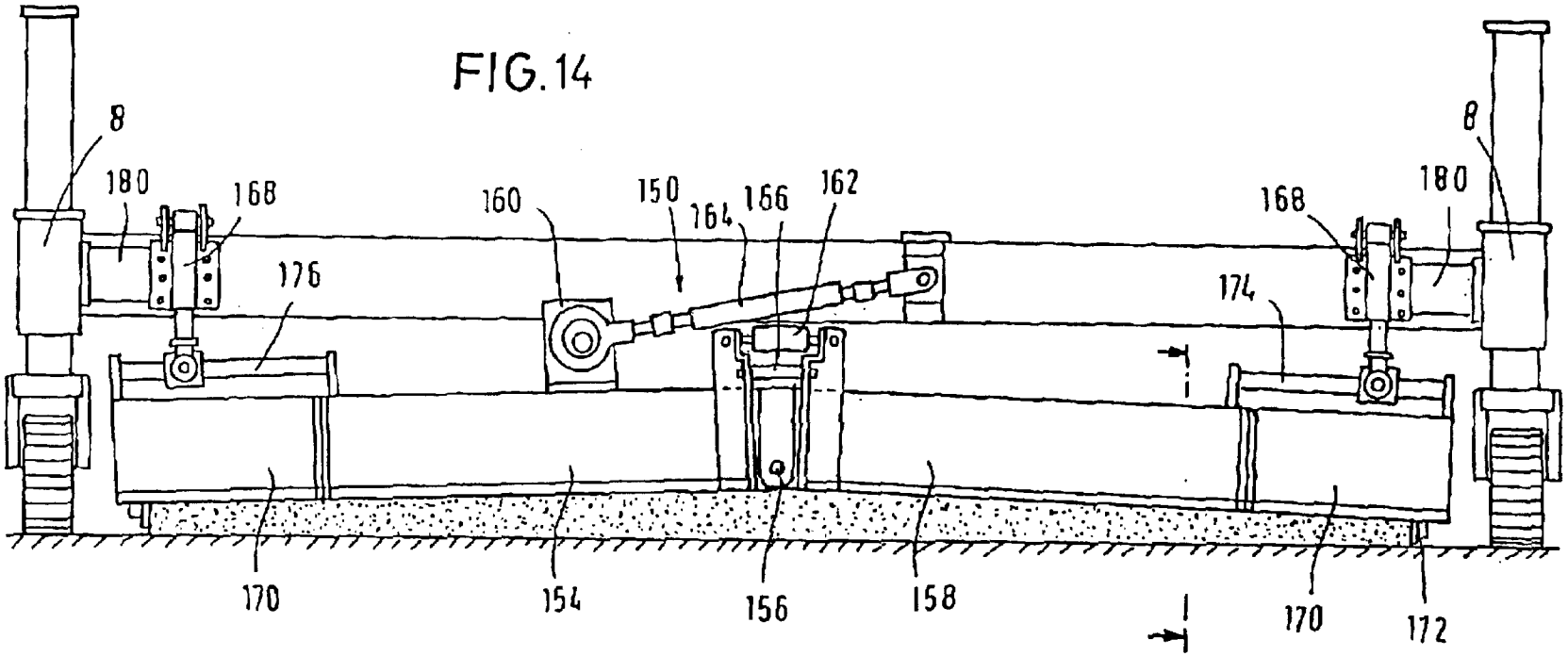
FIG. 14 is a front view of a transverse smoothing board.
Figure 15:
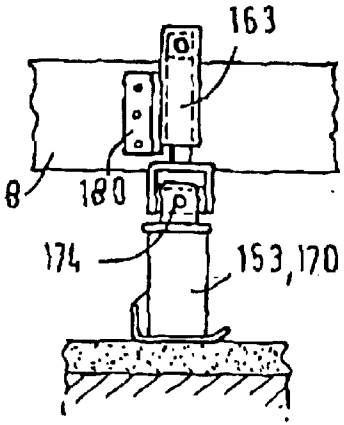
FIG. 15 is a side elevational view of the transverse smoothing board.

FIGS. 14 and 15 illustrate an embodiment of a transverse smoothing board 150. The transverse smoothing board 150 comprises two board segments 154, 158 of about 2.20 m in width connected at their lower edge by a hinge 156 in the middle of the machine so as to make setting a roof profile possible. Above both board segments 154, 158, a piston-cylinder unit 162 is provided horizontally for pressing both board segments 154, 158 apart. To make sure that the two board segments 154, 158 do not hang down in a V-profile form, a sleeve 166 limits the distance between two reference points of the board segments 154, 158.

On both sides of the board segments 154, 148 extension boards 120 may be fastened by screwing.

By means of an eccentric drive 160, an oscillating transverse movement of the transverse smoothing board may be obtained using a push rod 164.

The outer ends of the board segments 154, 158 or the extensions 170 (as illustrated in FIG. 14), a sliding guide 174, 176 may be mounted. The sliding guides 174, 176 are fastened to the longitudinal beam 8 by means of a vertical adjustment means 168 and a connecting member 180.

The connecting member 180 can slide for about 700 mm on each sliding guide 174, 176. Thus, the transverse smoothing board allows for a change in width of the tractor 2 of about 1.40 m without any restructuring. When the working width is reduced by 1.40 m, the board segments 154, 158 or the extension boards 170 project for about 70 cm beyond the machine frame on the left and on the right. Using the vertical adjustment means 168, the transverse smoothing board is manually vertically adjustable through a spindle. This adjustment is within the range of millimeters and serves to correct the surface to its desired finishing thickness.

Although a preferred embodiment of the invention has been specifically illustrated and described herein, it is to be understood that minor variations may be made in the apparatus without departing from the spirit and scope of the invention, as defined by the appended claims.

We claim:

1. A slip-form paver comprising a machine frame (4) having opposite side frame portions (8, 8), means (18) for variably adjusting the distance between the side frame portions (8, 8) whereby the working width of the slip-form paver can be selectively varied between minimum and maximum working widths, a single longitudinally extending guide (56) disposed in substantially transverse relationship between said side frame portions (8, 8), said single guide (56) having opposite free terminal end portions defining therebetween a predetermined length of said single longitudinally extending guide (56), a work carriage (70), means (68) for effecting selective reciprocal movement of said work carriage (70) along said single longitudinally extending guide (56), and said machine frame (4) including means (66) cooperative with said single longitudinally extending guide (56) for effecting selective reciprocal movement of said single longitudinally extending guide (56) relative to said machine frame (4) whereby said work carriage (70) can operate between said minimum and maximum working widths.

2. The slip-form paver as defined in claim 1 wherein the predetermined length of said single longitudinally extending guide (56) corresponds substantially to at least the minimum working width of the slip-form paver as established by said variably adjusting means (18).

3. The slip-form paver as defined in claim 1 wherein the predetermined length of said single longitudinally extending guide (56) is substantially less than the maximum working width of the slip-form paver as established by said variably adjusting means (18).

4. The slip-form paver as defined in claim 1 wherein the predetermined length of said single longitudinally extending guide (56) corresponds substantially between the minimum and maximum working widths of the slip-form paver as established by said variably adjusting means (18).

5. The slip-form paver as defined in claim 1 including a support beam (61) disposed substantially parallel to said single longitudinally extending guide (56), and said support beam (61) carries said cooperative means (66).

6. The slip-form paver as defined in claim 1 including a support beam (61) disposed substantially parallel to said single longitudinally extending guide (56), said support beam (61) carries said cooperative means (66), said support beam (61) being of a predetermined length, and means for increasing the length of the support beam (61).

7. The slip-form paver as defined in claim 1 wherein the single longitudinally extending guide (56) is defined by at least two substantially vertically spaced substantially parallel guide beams (60, 62).

8. The slip-form paver as defined in claim 1 wherein the single longitudinally extending guide (56) is defined by at least two substantially vertically spaced substantially parallel guide beams (60, 62), and said cooperative means (66) are rollers (66, 66) in rolling engagement with said at least two substantially vertically spaced substantially parallel guide beams (60, 62).

9. The slip-form paver as defined in claim 1 wherein the work carriage movement effecting means (68) are defined by rollers.

10. The slip-form paver as defined in claim 1 wherein the single longitudinally extending guide (56) is defined by at least two substantially vertically spaced substantially parallel guide beams (60, 62) each of a substantially polygonal transverse cross-section.

11. The slip-form paver as defined in claim 1 wherein the single longitudinally extending guide (56) is defined by at least two substantially vertically spaced substantially parallel guide beams (60, 62), and said guide beams (60, 62) each include a guide surface defining an angle to the horizontal ranging between substantially 30° to 60°.

12. The slip-form paver as defined in claim 1 wherein the single longitudinally extending guide (56) is defined by at least two substantially vertically spaced substantially parallel guide beams (60, 62), and said guide beams (60, 62) each include a guide surface defining an angle to the horizontal of substantially 45°.

13. The slip-form paver as defined in claim 1 wherein the single longitudinally extending guide (56) is defined by at least two substantially vertically spaced substantially parallel guide beams (60, 62), and the work carriage movement effecting means (68) are located between and in engagement with said guide beams (60, 62).

14. The slip-form paver as defined in claim 1 wherein the single longitudinally extending guide (56) is defined by at least two substantially vertically spaced substantially parallel guide beams (60, 62), the work carriage movement effecting means (68) engage said guide beams (60, 62) at a first side thereof, and said cooperative means (66) engage said guide beams (60, 62) at a second side thereof opposite said first side.

15. The slip-form paver as defined in claim 1 wherein the single longitudinally extending guide (56) is defined by at least two substantially vertically spaced substantially parallel guide beams (60, 62), the work carriage movement effecting means (68) engage said guide beams (60, 62) at inner opposing guide surfaces thereof, and said cooperative means (66) engage said guide beams (60, 62) at outer non-opposing guide surfaces thereof.

16. The slip-form paver as defined in claim 1 wherein said work carriage movement effecting means (68) are a plurality of horizontally and vertically spaced rollers (66, 68) associated with said work carriage (70) and said single longitudinally extending guide (56).

17. The slip-form paver as defined in claim 1 wherein said work carriage movement effecting means (68) are a plurality of horizontally and vertically spaced rollers (66, 68) associated with said work carriage (70) and said single longitudinally extending guide (56), and said plurality of horizontally and vertically spaced rollers (66, 68) each are arranged in pairs of rollers having axes of rotation which define an angle of substantially 90° therebetween.

18. The slip-form paver as defined in claim 1 including flexible means (74*a*, 74*b*; 75*a*, 75*b*) secured to the work carriage (70) whereby motion can be imparted to the latter.

19. The slip-form paver as defined in claim 1 including flexible means (74*a*, 74*b*; 75*a*, 75*b*) secured to the work carriage (70) whereby motion can be imparted to the latter, and driven rope reel means about which said flexible means (74*a*, 74*b*; 75*a*, 75*b*) are at least partially entrained for imparting selective reciprocal motion to said work carriage (70).

20. The slip-form paver as defined in claim 1 including flexible means (86) secured to the working carriage (70) for selectively lifting and lowering said work carriage (70).

21. The slip-form paver as defined in claim 1 wherein said work carriage (70) carries a distributor knife (94), and means (86, 90) for vertically adjusting said distributor knife (94) relative to said work carriage.

22. The slip-form paver as defined in claim 1 wherein said working carriage (70) carries a longitudinal smoothing board (120).

23. The slip-form paver as defined in claim 1 including means (74*a*, 74*b*; 75*a*, 75*b*) for selectively reciprocally moving said single longitudinally extending guide (56) between said side frame portions (8, 8).

24. The slip-form paver as defined in claim 2 including a support beam (61) disposed substantially parallel to said single longitudinally extending guide (56), and said support beam (61) carries said cooperative means (66).

25. The slip-form paver as defined in claim 2 wherein the work carriage movement effecting means (68) are defined by rollers.

26. The slip-form paver as defined in claim 2 wherein the single longitudinally extending guide (56) is defined by at least two substantially vertically spaced substantially parallel guide beams (60, 62) each of a substantially polygonal transverse cross-section.

27. The slip-form paver as defined in claim 2 wherein the single longitudinally extending guide (56) is defined by at least two substantially vertically spaced substantially parallel guide beams (60, 62).

28. The slip-form paver as defined in claim 2 wherein the single longitudinally extending guide (56) is defined by at least two substantially vertically spaced substantially parallel guide beams (60, 62), and the work carriage movement effecting means (68) are located between and in engagement with said guide beams (60, 62).

29. The slip-form paver as defined in claim 2 wherein said work carriage movement effecting means (68) are a plurality of horizontally and vertically spaced rollers (66, 68) associated with said work carriage (70) and said single longitudinally extending guide (56).

30. The slip-form paver as defined in claim 2 including means (74*a*, 74*b*; 75*a*, 75*b*) for selectively reciprocally moving said single longitudinally extending guide (56) between said side frame portions (8, 8).

31. The slip-form paver as defined in claim 3 including a support beam (61) disposed substantially parallel to said single longitudinally extending guide (56), and said support beam (61) carries said cooperative means (66).

32. The slip-form paver as defined in claim 3 wherein the work carriage movement effecting means (68) are defined by rollers.

33. The slip-form paver as defined in claim 3 wherein the single longitudinally extending guide (56) is defined by at least two substantially vertically spaced substantially parallel guide beams (60, 62) each of a substantially polygonal transverse cross-section.

34. The slip-form paver as defined in claim 3 wherein the single longitudinally extending guide (56) is defined by at least two substantially vertically spaced substantially parallel guide beams (60, 62).

35. The slip-form paver as defined in claim 3 wherein the single longitudinally extending guide (56) is defined by at least two substantially vertically spaced substantially parallel guide beams (60, 62), and the work carriage movement effecting means (68) are located between and in engagement with said guide beams (60, 62).

36. The slip-form paver as defined in claim 3 wherein said work carriage movement effecting means (68) are a plurality of horizontally and vertically spaced rollers (66, 68) associated with said work carriage (70) and said single longitudinally extending guide (56).

37. The slip-form paver as defined in claim 3 including means (74*a*, 74*b*; 75*a*, 75*b*) for selectively reciprocally moving said single longitudinally extending guide (56) between said side frame portions (8, 8).

38. The slip-form paver as defined in claim 4 including a support beam (61) disposed substantially parallel to said single longitudinally extending guide (56), and said support beam (61) carries said cooperative means (66).

39. The slip-form paver as defined in claim 4 wherein the work carriage movement effecting means (68) are defined by rollers.

40. The slip-form paver as defined in claim 4 wherein the single longitudinally extending guide (56) is defined by at least two substantially vertically spaced substantially parallel guide beams (60, 62) each of a substantially polygonal transverse cross-section.

41. The slip-form paver as defined in claim 4 wherein the single longitudinally extending guide (56) is defined by at least two substantially vertically spaced substantially parallel guide beams (60, 62).

42. The slip-form paver as defined in claim 4 wherein the single longitudinally extending guide (56) is defined by at least two substantially vertically spaced substantially parallel guide beams (60, 62), and the work carriage movement effecting means (68) are located between and in engagement with said guide beams (60, 62).

43. The slip-form paver as defined in claim 4 wherein said work carriage movement effecting means (68) are a plurality of horizontally and vertically spaced rollers (66, 68) associated with said work carriage (70) and said single longitudinally extending guide (56).

44. The slip-form paver as defined in claim 4 including means (74*a*, 74*b*; 75*a*, 75*b*) for selectively reciprocally moving said single longitudinally extending guide (56) between said side frame portions (8, 8).

* * * * *

UNITED STATES PATENT AND TRADEMARK OFFICE

CERTIFICATE OF CORRECTION

PATENT NO. : 6,872,028 B2
APPLICATION NO. : 10/221478
DATED : March 29, 2005
INVENTOR(S) : Werner Aeschlimann et al.

It is certified that error appears in the above-identified patent and that said Letters Patent is hereby corrected as shown below:

On Title Page, col. 1 Item (75) please add,

Martin Lenz ,
Grossmaischeid (DE)

On Title Page, col. 1 Item (30) please add,

(30) Foreign Application Priority Data

June 13, 2001 (DE) . . . . . 101 28 564.7

Signed and Sealed this

Twenty-second Day of August, 2006

JON W. DUDAS
*Director of the United States Patent and Trademark Office*